United States Patent [19]

Whitfield

[11] 4,057,198

[45] Nov. 8, 1977

[54] FIRE HOSE WINDING APPARATUS

[76] Inventor: Bert Dean Whitfield, Murdock Staff House, Butner, N.C. 27509

[21] Appl. No.: 717,629

[22] Filed: Aug. 25, 1976

[51] Int. Cl.[2] ..... B65H 75/40

[52] U.S. Cl. ..... 242/86.2

[58] Field of Search ..... 242/86, 86.1, 86.2, 242/86.5 R; 137/355.12, 355.16

[56] References Cited

U.S. PATENT DOCUMENTS

| | | | |
|---|---|---|---|
| 600,333 | 3/1898 | Meeker | 242/86 |
| 3,124,321 | 3/1964 | Ryloft | 242/86.2 |
| 3,827,097 | 8/1974 | Hamann | 242/86 |

FOREIGN PATENT DOCUMENTS

| | | | |
|---|---|---|---|
| 532,978 | 2/1941 | United Kingdom | 242/86 |

*Primary Examiner*—Edward J. McCarthy

[57] ABSTRACT

Disclosed is a hand-operated apparatus for winding lengths of fire hose of the type having male and female interlocking coupling members on opposite ends thereof. The apparatus has a horizontal base mounted on four wheels and an upright support structure which mounts a reel assembly. The reel assembly includes a circular disc mounted on a drive shaft which is driven by a hand crank. The disc has a pair of outwardly extending elongated tines for engaging the male coupling member of the hose. The hose is directed to the reel past an idler roller and an adjustable hose guide assembly which serve to compress the hose and drain any water that may be present and which also serve to align the hose with the tines so that it does not have to be straightened before the winding operation. The reel is centrally located above the base structure to provide overall balance for the apparatus in both loaded and unloaded situations. The upper idler roller includes an adjustable guide for accommodating different size hoses.

1 Claim, 3 Drawing Figures

FIRE HOSE WINDING APPARATUS

BACKGROUND OF THE INVENTION

1. Field of the Invention

The invention relates to apparatus for winding fire hose.

2. Description of the Prior Art

After a fire fighting operation, each length of fire hose must be wound up at the scene of the fire for the return trip to the fire station. At the station the hose must be unrolled and placed on drying racks and then wound up again for storage. Furthermore, safety regulations require that all fire hose be unwound and inspected at regular intervals and, of course, the hose must be rewound for storage. Virtually all of these winding operations are presently performed by the fireman manually winding the hose into a convolute roll while he is positioned on his hands and knees. Before this manual winding operation is begun, the fireman must first drain the water from the hose and arrange the hose into a straight line.

Apparatus for winding fire hose have been proposed, but because of the complexity of the designs or the nonsatisfactory results obtained, no known device has found commercial acceptance. Patent No. 3,124,321 describes a device having a gasoline engine which drives a reel about a horizontal axis through a series of sprockets, chains and gear reducers. The reel includes a large disc member from which extends a pair of tines for engaging the coupling member at one end of the hose. A hose guide adapts the device to different widths of hose. One disadvantage of this patented apparatus is that the hose is not sufficiently compressed or otherwise acted upon by the apparatus to automatically drain water from the hose; therefore, the hose must be drained as a step preparatory to winding. Another disadvantage of the patented apparatus is that with the hose being routed over only a single guide roller, the hose must still be straightened before the winding operation. Yet another disadvantage is that the reel is mounted to the side of the support frame structure thereby causing an imbalance in the device when it is loaded with the hose.

Thus, it becomes an object of the present invention to provide a simple hand-operated device for winding fire hose having means for automatically draining water from the hose, having an overall balance in both loaded and unloaded situations and not requiring the straightening of the hose before winding.

SUMMARY OF THE INVENTION

The fire hose winding apparatus of the present invention comprises a horizontal base which supports a vertical structure which, in turn, mounts a reel assembly. The reel includes a pair of outwardly projecting tines or pin members. The hose next to the male coupling member of a fire hose section is placed between the tines preparatory to winding. The vertical support also mounts forward of the reel assembly a pair of idler rollers which serve to flatten out the hose and drain water therefrom. The idler rollers also serve to route or "thread" the hose so that it need not be straightened before the winding operation. The tines and idler rollers are aligned along the longitudinal gravitational center of the apparatus so that the apparatus will be balanced both before and after the winding operation. The idler roller closer to the reel assembly is provided with an adjustable disc at its outer end to guide the outer edge of the flattened hose during winding.

DESCRIPTIONS OF THE DRAWINGS

DESCRIPTION OF THE PREFERRED EMBODIMENT

Figure 1:
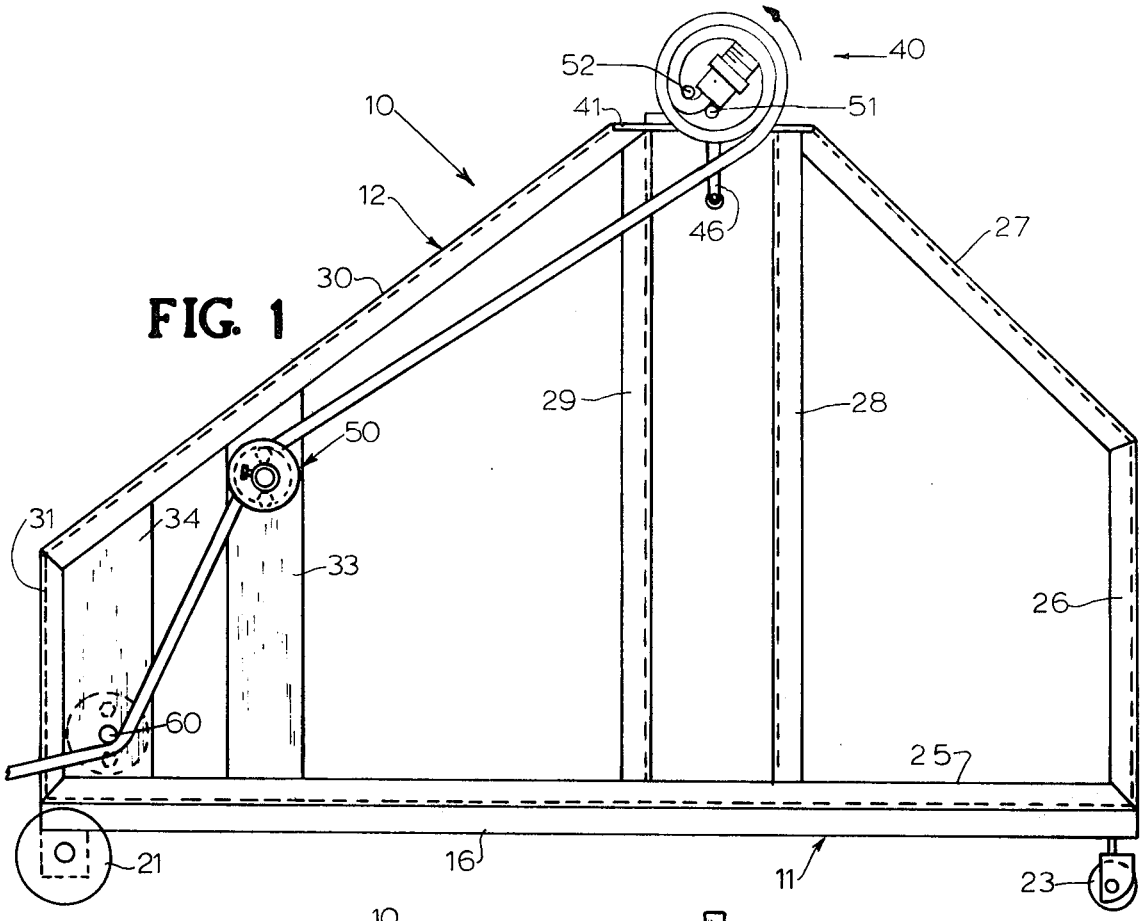
FIG. 1 is a side elevation view of the fire hose winding apparatus of the present invention.

Referring to the drawings, the fire hose winding apparatus 10 of the present invention includes a horizontal base support generally designated as 11, an upright support structure generally designated as 12, a reel assembly 40, an adjustable hose guide assembly 50 and an idler roller 60. Base 11 includes a pair of elongated frame members 15, 16 which are fixedly secured by welds or other suitable means to a pair of transverse frame members 17, 18. Four wheels 21, 22, 23, 24 mount at the ends of the transverse members 17, 18.

Figure 2:
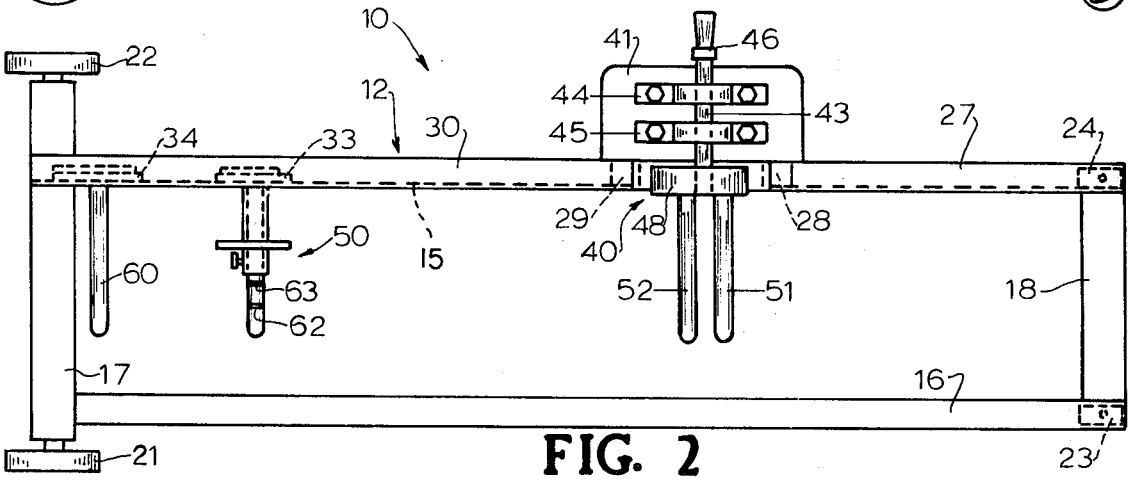
FIG. 2 is a top view of the apparatus illustrated in FIG. 1 with the hose not shown.

The upright support 12 comprises a structure of channel members 25, 26, 27, 28, 29, 30, 31 secured by welds or the like and which support the reel assembly 40. A pair of vertical plates 33, 34 support the guide assembly 50 and the idler roller 60 respectively. Reel assembly 40 is mounted on a horizontal support 41 which is in turn secured to the upper ends of channel members 28, 29. As best shown in FIG. 2, assembly 40 includes a drive shaft 43 mounted within a pair of shaft journals 44, 45 for rotational movement about a horizontal axis transverse to the longitudinal axis of the apparatus. A crank-type handle formation 46 is mounted on one end of the shaft. The other end of the shaft is connected to the rotational center of a circular disc member 48. A pair of elongated tine members 51, 52 extend from the outer surface of disc 48 and are held rigidly by means of welds, or the like. In the illustrated embodiment, tines 51, 52 are approximately 6 inches in length and are spaced approximately 1¼ inches apart.

Idler roller 60 is spaced forward of and somewhat lower than the hose guide assembly 50. The lower surface of roller 60 engages the hose and directs the hose to the upper surface of guide assembly 50. The hose is directed from assembly 50 to the lower portion of the convolute roll as it accumulates on reel assembly 40. A primary objective of the preferred routing of the fire hose is to compress the hose in the distance between idler roller 60 and reel assembly 40 so that water in the hose may be automatically drained during the winding operation. Another purpose of the roller and guide structure is to automatically straighten the hose before it is wound onto the convolute roll thereby eliminating the need for straightening the entire hose length preparatory to winding.

Figure 3:
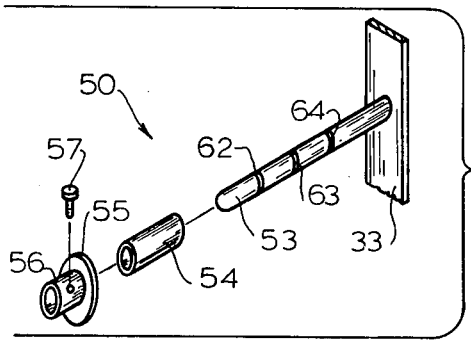
FIG. 3 is an enlarged, exploded perspective view of the adjustable hose guide assembly.

In order to accommodate different widths of fire hose, guide assembly 50 is made adjustable. As best shown in FIG. 3, assembly 50 includes a stationary post member 53 having adjustment grooves 62, 63, 64, a roller sleeve 54, and a guide disc 55. Post 53 is fixedly mounted on plate 33 by any suitable means. Sleeve 54 fits over post 53 and resides in the portion between plate 34 and adjustment groove 64. Sleeve 54 contacts the flattened hose during the winding operation and serves as an idler roller that rotates about post 53. Guide disc 55 is adapted to being positioned in three positions which correspond to the three most common hose widths (when flattened). Guide disc 55 includes an outwardly projecting sleeve 56 which has a threaded hole for receiving an adjustment screw 57. The tip of screw 57 is adapted to reside in one of grooves 62, 63, 64 according to the width of hose being wound.

In operation, the hose guide assembly is adjusted for the width of hose to be wound. The end of the hose containing the male coupling member is routed under roller 60, over guide 50, and the hose near the coupling member is placed between tines 51, 52. The operator then turns the reel in the direction indicated in FIG. 1 thereby causing the hose to be convolutely wound about tines 51, 52 until the entire hose length is formed into a convolute roll. As the last few feet of hose are wound onto the reel, the hose is disengaged from the idler rollers so that the female coupling member may be wound directly to the convolute roll.

In summary, the present invention provides a simple time-saving apparatus for the fireman. Trial tests have indicated that the time for winding a 50 foot section of hose may be reduced from approximately $1\frac{3}{4}$ minutes to approximately 15 seconds by use of the invention apparatus.

What is claimed is:

1. An apparatus for manually winding fire hose of the type having male and female coupling members at the respective ends thereof, comprising in combination:

a. a horizontal rectangular base structure mounting wheel means proximate the forward and rearward corners thereof for supporting the apparatus and including wheels pivotal on a vertical axis at each of the corners at the rearward end of said base structure;

b. vertical support structure means fixedly secured to and extending upwardly from said horizontal base;

c. hand-operated reel means mounted on the upper portion of said vertical support means and comprising:

i. a horizontal drive shaft journaled for rotation about a horizontal axis transverse to the longitudinal axis of the apparatus;

ii. handle means at a first end of said shaft for driving such shaft; and iii. enlarged disc means at the second end of said shaft mounting a pair of pin projections oppositely spaced equal distances from the rotational center of said disc;

d. first idler roller means projecting from said vertical support structure means and being longitudinally aligned with said pin projections substantially along the longitudinal gravitational center of said apparatus, said first idler roller means positioned at a lower forward end of said apparatus immediately above said base structures and immediately behind the wheel means located at such forward end; and e. second idler roller means projecting from said vertical support structure means and being longitudinally aligned with said pin projections and first idler roller means and being positioned therebetween at a position higher than and rearwardly of said first idler roller means and lower than said pin projections, said second idler roller means being adjustable to different widths of flattened hose and including a fixed post member mounted on said vertical support structure means, a roller sleeve adapted for rotation about said post and a guide disc adjustably mounted at the outward end of said post member for engaging an edge portion of the flattened hose whereby a fire hose length may be wound upon said apparatus with the hose routed under the bottom roller surface of said first idler roller means, over the top roller surface of said second idler roller means and onto the pin projections of said reel means.

* * * * *

UNITED STATES PATENT OFFICE

CERTIFICATE OF CORRECTION

Patent No. 4,057,198 Dated November 8, 1977

Inventor(s) Bert Dean Whitfield

It is certified that error appears in the above-identified patent and that said Letters Patent are hereby corrected as shown below:

Col. 2, line 65, "34" should be --33--

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*